US008836209B2

(12) United States Patent
Baek et al.

(10) Patent No.: US 8,836,209 B2
(45) Date of Patent: Sep. 16, 2014

(54) DISPLAY APPARATUS

(75) Inventors: Seung Hwan Baek, Seoul (KR); Myeong-Ju Shin, Seoul (KR); Yeongbae Lee, Bucheon (KR)

(73) Assignee: Samsung Display Co., Ltd. (KR)

( * ) Notice: Subject to any disclaimer, the term of this patent is extended or adjusted under 35 U.S.C. 154(b) by 162 days.

(21) Appl. No.: 13/475,148

(22) Filed: May 18, 2012

(65) Prior Publication Data

US 2013/0016522 A1 Jan. 17, 2013

(30) Foreign Application Priority Data

Jul. 15, 2011 (KR) ..... 10-2011-0070693

(51) Int. Cl.
*G09F 13/20* (2006.01)

(52) U.S. Cl.
CPC ..... *G09G 13/04* (2013.01); *G09F 13/20* (2013.01)
USPC ..... 313/501; 345/690

(58) Field of Classification Search
USPC ..... 313/501; 345/690
See application file for complete search history.

(56) References Cited

U.S. PATENT DOCUMENTS

| | | | | |
|---|---|---|---|---|
| 5,813,752 | A * | 9/1998 | Singer et al. | 362/293 |
| 2003/0052836 | A1* | 3/2003 | Matsumoto et al. | 345/6 |
| 2004/0090577 | A1* | 5/2004 | Hara | 349/117 |
| 2007/0013624 | A1* | 1/2007 | Bourhill | 345/84 |
| 2011/0109663 | A1* | 5/2011 | Uchida et al. | 345/690 |
| 2012/0013654 | A1* | 1/2012 | Yashiro et al. | 345/690 |

FOREIGN PATENT DOCUMENTS

| | | |
|---|---|---|
| KR | 1020070101046 | 10/2007 |
| KR | 1020080035896 | 4/2008 |
| KR | 1020080037778 | 5/2008 |

* cited by examiner

*Primary Examiner* — Mary Ellen Bowman
(74) *Attorney, Agent, or Firm* — Cantor Colburn LLP

(57) ABSTRACT

A display apparatus includes a backlight unit which generates first light including first blue light, first green light and first red light and a display panel which receives the first light to display an image, where the backlight unit includes: a light emitting diode which generates an ultraviolet ray; a fluorescent substance layer disposed on the light emitting diode, where the fluorescent substance layer includes: a blue fluorescent substance layer which receives the ultraviolet ray and emits blue light; a green fluorescent substance layer which receives the ultraviolet ray and emits green light; and a red fluorescent substance layer which receives the ultraviolet ray and emits red light; and a first band-pass filter which receives the blue light, the green light and the red light and outputs the first blue light, the first green light and the first red light.

25 Claims, 16 Drawing Sheets

DISPLAY APPARATUS

This application claims priority to Korean Patent Application No. 10-2011-0070693, filed on Jul. 15, 2011, and all the benefits accruing therefrom under 35 U.S.C. §119, the content of which in its entirety is herein incorporated by reference.

BACKGROUND OF THE INVENTION

1. Field of Disclosure

Exemplary embodiments of the invention relate to a display apparatus. More particularly, exemplary embodiments of the invention relate to a display apparatus that displays a three dimensional ("3D") image using an ultraviolet ray light emitting diode ("UV LED").

2. Description of the Related Art

In general, a method of configuring a light source generating white light using a light emitting diode is classified into a multi-diode method of producing white light using a plurality of light emitting diodes that emit lights of colors different from each other and a fluorescent substance application method of producing white light by disposing a fluorescent substance on a blue light emitting diode.

In the multi-diode method, the light source includes the light emitting diodes that emit red light, green light and blue light, respectively, and the red, green and blue lights are mixed with each other to produce the white light. In the fluorescent substance application method, the light source includes a light emitting diode that emits the blue light and the fluorescent substance excited by the blue light to emit the green and red lights, and thus the red, green and blue lights are mixed with each other to produce the white light.

The blue light emitted from the blue light emitting diode generally has a relatively large peak value and a relatively small full width at half maximum ("FWHM"). Thus, the blue light emitting diode is hardly used in a 3D image display apparatus using a wavelength separation method that provides the 3D image by separating a left-eye image and a right-eye image having peak wavelengths different from each other in a wavelength range of the blue light.

BRIEF SUMMARY OF THE INVENTION

Exemplary embodiments of the invention provide a display apparatus which displays a three-dimensional ("3D") image using an ultraviolet ray light emitting diode ("UV LED").

According to an exemplary embodiment, a display apparatus includes a backlight unit which generates first light including first blue light, first green light and first red light and a display panel which receives the first light to display an image, where the backlight unit includes: a light emitting diode which generates an ultraviolet ray; a fluorescent substance layer disposed on the light emitting diode, where the fluorescent substance layer includes: a blue fluorescent substance layer which receives the ultraviolet ray and emits blue light; a green fluorescent substance layer which receives the ultraviolet ray and emits green light; and a red fluorescent substance layer which receives the ultraviolet ray and emits red light; and a first band-pass filter which receives the blue light, the green light and the red light and outputs the first blue light, the first green light and the first red light.

In an exemplary embodiment, the display panel may reduce a difference in color reproducibility and a difference in brightness between a left-eye image and a right-eye image, thereby effectively providing the 3D image with improved display quality.

BRIEF DESCRIPTION OF THE DRAWINGS

The above and other aspects and features of the invention will become readily apparent by describing in detailed exemplary embodiments thereof with reference to the accompanying drawings, in which.

DETAILED DESCRIPTION OF THE INVENTION

Figure 1:
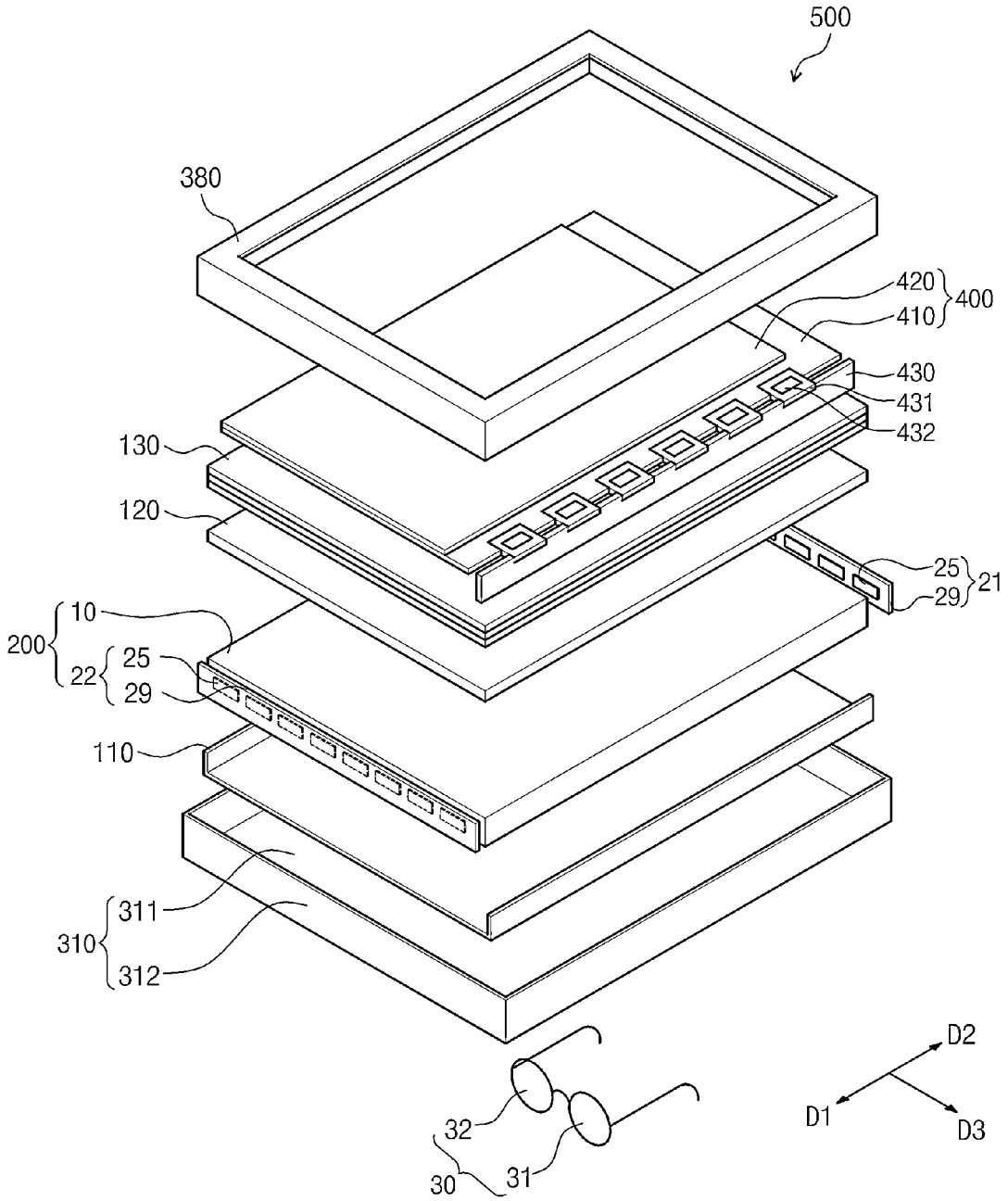
FIG. 1 is an exploded perspective view of an exemplary embodiment of a display apparatus according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the invention will be explained in detail with reference to the accompanying drawings.

FIG. 1 is an exploded perspective view of an exemplary embodiment of a display apparatus according to the invention.

Referring to FIG. 1, the display apparatus 500 includes a backlight unit 200, a display panel 400, a bottom chassis 310 and a top chassis 380.

The backlight unit 200 includes a first light source part 21, a second light source part 22 and a light guide plate 10.

The first and second light source parts 21 and 22 generate light used to display an image on the display apparatus 500. The light guide plate 10 guides the light emitted from the first and second light source parts 21 and 22 to the display panel 400.

The first light source part 21 is disposed adjacent to one side of the light guide plate 10 and the light emitted from the first light source part 21 is provided to the light guide plate 10. The second light source part 22 is disposed adjacent to another side of the light guide plate 10 and opposite to the first light source part 21, and the light emitted from the second light source 22 is provided to the light guide plate 10.

In such an embodiment, each of the first light source part 21 and the second light source part 22 includes a plurality of light emitting diode packages 25 and a printed circuit board 29. The light emitting diode packages 25 are arranged on the printed circuit board 29 along a third direction D3. The light emitting diode packages 25 included in the first light source part 21 emit light toward a first direction D1 substantially perpendicular to the third direction D3, and the light emitting diode packages 25 emit light toward a second direction D2 substantially opposite to the first direction.

The printed circuit board 29 is disposed substantially parallel to the light guide plate 10 and electrically connected to the light emitting diode packages 25 to apply a driving voltage to the light emitting diode packages 25. In one exemplary embodiment, as shown in FIG. 1, the printed circuit board 29 may be disposed substantially vertical to a light emitting surface of light emitting diodes (not shown in FIG. 1) included inside the light emitting diode packages 25.

The light emitted from the light diode packages 25 travels in the first direction D1 or the second direction D2 to be provided to the light guide plate 10, and the light guide plate 10 guides the light emitted from the light emitting diode packages 25 to the display panel 400.

The display apparatus 500 may further include a glasses unit 30 to allow a user to watch a three dimensional ("3D") image, and the glasses unit 30 may include a first filter glass 31 for a left-eye image and a second filter glass 32 for a right-eye image. A portion of the light emitted from the light emitting diode packages 25 may be provided to the user through the first filter glass 31 and a remaining portion of the light emitted from the light emitting diode packages 25 may be provide to the user through the second filter glass 32.

Accordingly, the light emitted from the light emitting diode packages 25 may be used to display the 3D image.

In an exemplary embodiment, the first light source part 21 and the second light source part 22 may be driven independent of each other, such that the lights having intensities different from each other may be provided to the light guide plate 10. In such an embodiment, the intensities of the lights provided to the display panel 400 from the light guide plate 10 may vary according to positions of the display panel 400, at which the 3D image is displayed, and thus the display apparatus 500 may be driven by a local dimming method.

In an exemplary embodiment, the display apparatus 500 may further include a reflection plate 110 disposed under the light guide plate 10. The reflection plate 110 includes a material that reflects light, such as polyethylene terephthalate ("PET") or aluminum, for example. In an exemplary embodiment, the reflection plate 110 may be disposed on a bottom portion 311 of the bottom chassis 310 to reflect the lights emitted from the first and second light source parts 21 and 22. In such an embodiment, the intensities of the lights provided to the display panel 400 may be enhanced by the reflection plate 110.

In an exemplary embodiment, the display apparatus 500 may further include a diffusion sheet 120 disposed between the display panel 400 and the light guide plate 10. The diffusion sheet 120 diffuses the light exiting from the light guide plate. In such an embodiment, the intensities of the lights, which are provided to the display panel 400, per unit area may become substantially uniform by the diffusion sheet 120.

In an exemplary embodiment, the display apparatus 500 may further include a plurality of optical sheets 130 disposed between the diffusion sheet 120 and the display panel 400. The optical sheets 130 may include prism sheets that condense the light exiting from the diffusion sheet 120 to improve a front brightness of the display panel 400. In exemplary embodiments, structure of the diffusion sheet 120 and the optical sheets 130 may vary.

According to the illustrated exemplary embodiment, the display panel 400 may be a liquid crystal display panel and receive the light generated by the backlight unit 200 to display an image. In an exemplary embodiment, the display apparatus 500 may be used as a 3D image display apparatus that displays the left-eye image and the right-eye image, and the display panel 400 may display the 3D image using the lights emitted from the light emitting diode packages 25. In such an embodiment, the display panel 400 may alternately display the left-eye image and the right-eye image every frame. The display panel 400 may display the left-eye image when first light including first blue light, first green light and first red light is emitted from the first and second light source parts 21 and 22, and display the right-eye image when the first light and second light including second blue light, second green light and second red light are emitted from the first and second light source parts 21 and 22. Wavelengths of the first and second lights are different from each other, and the first and second lights will be described later in greater detail.

The display panel 400 includes a first substrate 410, a second substrate 420 facing the first substrate 410, and a liquid crystal layer (not shown) disposed between the first substrate 410 and the second substrate 420.

In an exemplary embodiment, the first substrate 410 may include a plurality of pixel electrodes (not shown) and a plurality of thin film transistors (not shown) electrically connected to the pixel electrodes in a one-to-one correspondence. Each thin film transistor switches a driving signal applied to a corresponding pixel electrode among the pixel electrodes. In such an embodiment, the second substrate 420 may include color filter layers at positions corresponding to the pixel electrodes in a one-to-one correspondence and an opposing electrode that generates an electric field in cooperation with the pixel electrodes to arrange liquid crystal molecules in the liquid crystal layer.

A printed circuit board 430 is disposed adjacent to one side of the display panel 400 to output a driving signal to the display panel 400. The printed circuit board 430 is connected to the display panel 400 by a plurality of tape carrier packages ("TCP"s) 431, and a plurality of driving chips 432 may be mounted on the TCPs 431, respectively.

Each of the driving chips 432 may include a data driver (not shown) that applies a data signal to the display panel 400. In an exemplary embodiment, a gate driver (not shown) that applies a gate signal to the display panel 400 may be directly provided on the display panel 400 through a thin film process. In an exemplary embodiment, the driving chips 432 may be mounted on the display panel 400 in a chip-on-glass ("COG") package. In such an embodiment, the driving chips 432 may be integrated in a single chip.

In an exemplary embodiment, the bottom chassis 310 includes the bottom portion 311 and sidewalls 312 extend from the bottom portion 311 to provide a receiving space that accommodates the backlight unit 200 and the display panel 400. In such an embodiment, the top chassis 380 is coupled with the bottom chassis 310 to securely fix the backlight unit 200 and the display panel 400 to the bottom chassis 310.

In an exemplary embodiment, as shown in FIG. 1, the first and second light source parts 21 and 22 of the backlight unit 200 may be disposed adjacent to a short side of the display panel 400, but the invention is not limited thereto or thereby. In an alternative exemplary embodiment, the first and second light source parts 21 and 22 may be disposed adjacent to a long side of the display panel 400, or the display panel 400 may further include additional light source parts disposed adjacent to the long side of the display panel 400.

Figure 2:
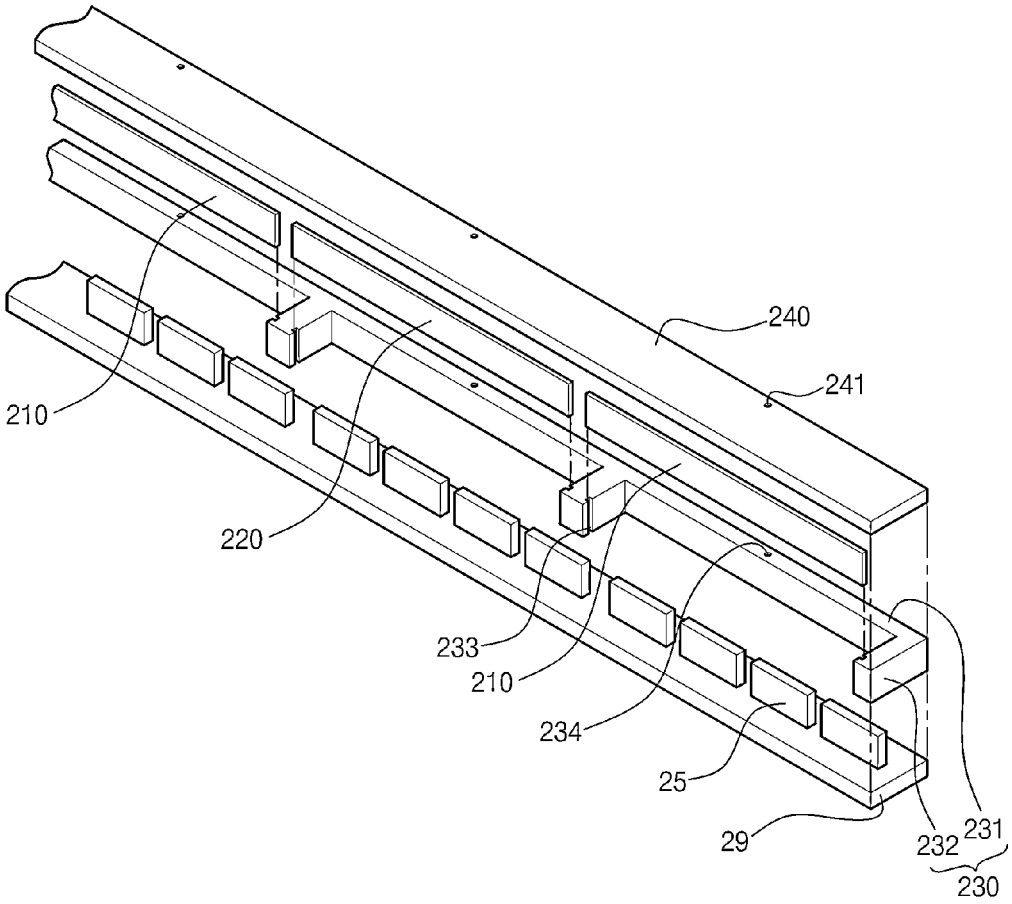
FIG. 2 is an exploded perspective view of an exemplary embodiment of a first light source part shown in FIG. 1.

FIG. 2 is an exploded perspective view of the first light source part shown in FIG. 1. In the illustrated exemplary embodiment, the first light source part 21 and the second light source part 22 have substantially the same structure and function, and hereinafter only the first light source part 21 will be described in detail for the convenience of description.

Referring to FIGS. 1 and 2, the first light source part 21 further includes a first frame 230, a second frame 240, a first band-pass filter 210 and a second band-pass filter 220.

The first frame 230 includes a first sub-frame 231 and a plurality of second sub-frames 232 substantially vertically extend from the first sub-frame 231 and covers at least a side surface of the light emitting diode packages 25. The first sub-frame 230 is disposed on the printed circuit board 29 and has a flat plate shape to cover a rear surface of the light emitting diode packages 25. In an exemplary embodiment, the first sub-frame 231 may include a first coupling hole 234 to be coupled with the second frames 240.

The second sub-frames 232 extend from the first sub-frame 231 and cover side surfaces of the light emitting diode packages 25. Each of the second sub-frames 232 includes a receiving recess to accommodate the first and second ban-pass filters 210 and 220, and the first and second band-pass filters 210 and 220 are inserted into the receiving recess 233.

In an exemplary embodiment, each of the first and second band-pass filters 210 and 220 is disposed between two adjacent second sub-frames 232 and inserted into the receiving recess 233 formed on the two adjacent second sub-frames 232. In such an embodiment, the first and second band-pass filters 210 and 220 may be inserted into the receiving recess 233 from an upper portion of the first frame 230 to a lower portion of the first frame 230 after the printed circuit board 29 is coupled with the first frame 230. The first and second band-pass filters 210 and 220 are alternately arranged along a direction in which the light emitting diode packages 25 are arranged, e.g., the third direction D3.

The second frame 240 faces the printed circuit board 29 and covers the first and second band-pass filters 210 and 220 to fix the first and second band-pass filters 210 and 220 to the receiving recess 233. The second frame 240 may include a second coupling hole 241 coupled with the first coupling hole 234 by a coupling member (not shown). In an exemplary embodiment, the second frame 240 is disposed on the first frame 230 and the first and second band-pass filters 210 and 220 to effectively prevent the light, which is generated by the light emitting diode packages 29, from directly traveling to the display panel 400 without passing through the light guide plate 10.

Each of the first and second band-pass filters 210 and 220 transmits the light of a specific band and reflects or absorbs the light except for the light of the specific band. In one exemplary embodiment, for example, each of the first and second band-pass filters 210 and 220 may be an interference filter. Although not shown in FIG. 2, each of the first and second band-pass filters 210 and 220 may be manufactured to have a structure in which a plurality of films having different refractive indexes are stacked on one another. In one exemplary embodiment, for example, the films may include polyethylene naphthalate ("PEN") or polystyrene ("PS").

The light emitting diode packages 29 and the first and second band-pass filters 210 and 220 will be described later in greater detail with reference to FIG. 4.

Figure 3:
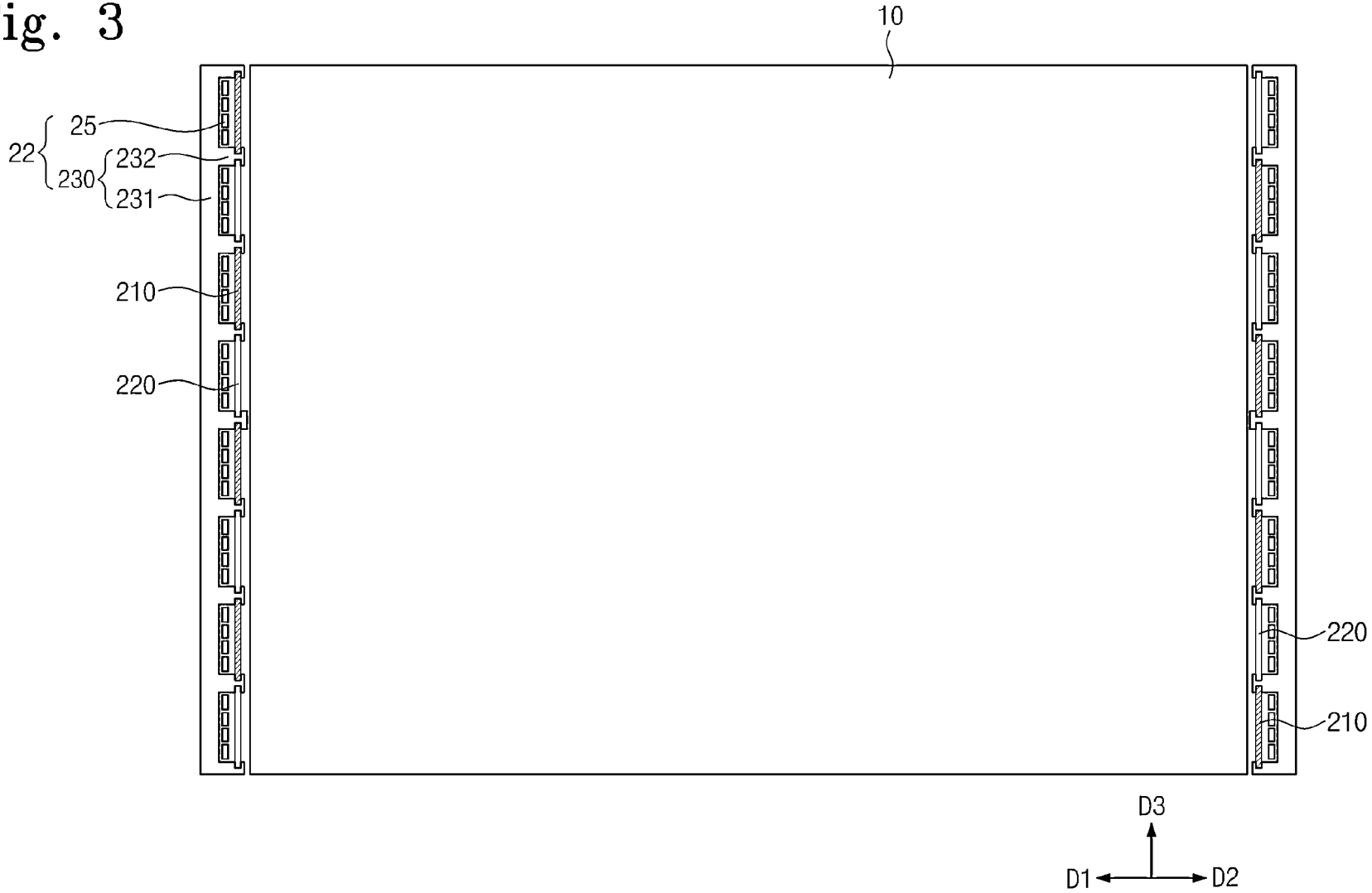
FIG. 3 is a plan view of an exemplary embodiment of a backlight unit shown in FIG. 1.

FIG. 3 is a plan view of an exemplary embodiment of a backlight unit shown in FIG. 1.

Referring to FIG. 3, the first light source part 21 includes 32 light emitting diode packages 25, the printed circuit board 29 mounted thereon with the light emitting diode packages 25, and the first frame 230 covering at least one side surface of the light emitting diode packages 25. In FIG. 3, four light emitting diode packages 25 are disposed between two second sub-frames 232, but the invention is not limited thereto or thereby.

The first band-pass filter 210 is disposed on the light emitting surface of a part of the light emitting diode packages 25, and the second band-pass filter 220 is disposed on the light emitting surface of the remaining part of the light emitting diode packages 25. In an exemplary embodiment, the first light source part 21 includes the first and second band-pass filters 210 and 220 alternately arranged in the third direction D3, and each of one first band-pass filter 210 and one second band-pass filter 220 corresponds to four light emitting diode packages 25.

The second light source part 22 faces the first light source part 21, and the light guide plate 10 is interposed therebetween. In one exemplary embodiment, for example, the second light source part 22 includes light emitting diode packages 25, the printed circuit board 29 mounted thereon with the light emitting diode packages 25, and the first frame 230 covering at least one side surface of the light emitting diode packages 25.

The second light source part 22 includes the first and second band-pass filters 210 and 220 alternately arranged in the third direction D3, and each of one first band-pass filter 210 and one second band-pass filter 220 corresponds to fourth light emitting diode packages 25.

In FIG. 3, the first band-pass filter 210 of the first light source part 210 faces the second band-pass filter 220 of the second light source part 22, and the second band-pass filter 220 of the first light source part 21 faces the first band-pass filter 210 of the second light source part 22.

The display apparatus 500 temporally alternately turns on the light emitting diode packages that provide the light to the first band-pass filter 210 and the light emitting diode packages that provide the light to the second band-pass filter 220 to display the 3D image.

In exemplary embodiments, the number and arrangement of the light emitting diode packages and the number and arrangement of the first and second band-pass filters may vary.

Figure 4:
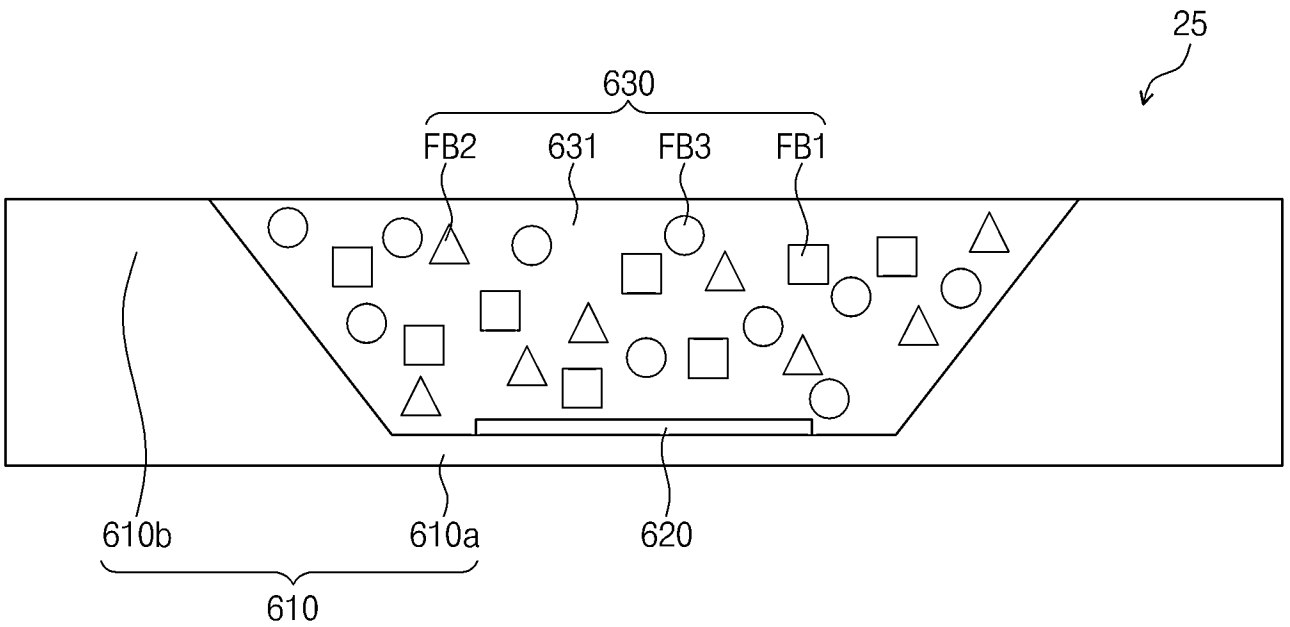
FIG. 4 is a cross-sectional view of an exemplary embodiment of a light emitting diode package shown in FIGS. 1 to 3.

FIG. 4 is a cross-sectional view of an exemplary embodiment of the light emitting diode package shown in FIGS. 1 to 3.

The light emitting diode package 25 includes a light emitting diode 620, a fluorescent substance layer 630 and a housing 610. In an exemplary embodiment, the light emitting diode 620 is disposed in the housing 610 and generates an ultraviolet ray. In an exemplary embodiment, the ultraviolet ray may have a wavelength from about 350 nanometers (nm) to about 400 nanometers (nm).

Although not shown in FIG. 4, the light emitting diode 620 is electrically connected to two lead frames that are electrically connected to the printed circuit board 29 to receive the driving voltage. Accordingly, the light emitting diode 620 generates the light in response to the voltage applied to the lead frames. Although not shown in FIG. 4, a heat-discharge pad or a heat-discharge plate may be disposed under the light emitting diode 620 to discharge heat generated from the light emitting diode 620.

The housing 610 includes a bottom portion 610*a* and a side portion 610*b* substantially vertically extending from the bottom portion 610*a*, and the housing 610 provides an inner space that accommodates the light emitting diode 620 and the fluorescent substance layer 630. In an exemplary embodiment, one side of the housing 610 is opened. As shown in FIG. 4, the light emitting diode 620 is disposed on the bottom portion 610*a*, and the fluorescent substance layer 630 is accommodated in a space defined by the bottom portion 610*a* and the side portion 610*b*.

The housing 610 may include an insulative polymer such as plastic. In one exemplary embodiment, for example, the housing 610 may be formed of polyphthalamide ("PPA") or ceramic. The bottom portion 610*a* and the side portion 610*b* may be integrally formed by a molding process when the housing 610 is manufactured.

The fluorescent substance layer 630 includes a polymer resin 631 and a plurality of fluorescent substances FB1, FB2 and FB3 dispersed in the polymer resin 631. The polymer resin 631 may include the insulating polymer, such as silicon resin, epoxy resin and acryl resin, for example.

The fluorescent substance layer 630 absorbs the ultraviolet ray emitted from the light emitting diode 620 to generate the blue light, the green light and the red light. In an exemplary embodiment, the fluorescent substance layer 630 includes a blue fluorescent substance FB1 that generates the blue light, a green fluorescent substance FB2 that generates the green light, and a red fluorescent substance FB3 that generates the red light. The blue, green and red fluorescent substances FB1, FB2 and FB3 may include at least one of an oxide-based compound, a sulphur-based compound and a nitride-based compound. Since the spectrum of the light depends on materials used for the blue, green and red fluorescent substances FB1, FB2 and FB3, the materials used for the blue, green and red fluorescent substances FB1, FB2 and FB3 may be selected according to the desired spectrum.

In an exemplary embodiment, the blue fluorescent substance FB1 may include at least one of $BaMg_2Al_{16}:Eu^{2+}$; $Sr_4Al_{14}O_{25}:Eu^{2+}$; $BaAl_{18}O_{13}:Eu^{2+}$; $(Sr,Mg,Ca,Ba)_5(PO_4)_3Cl:Eu^{2+}$; and $Sr_2Si_3O_8.2SrCl_2:Eu^{2+}$.

In an exemplary embodiment, the green fluorescent substance FB2 may include at least one of $(Sr,Ba,Ca,Mg)_2SiO_4:Eu^{2+}$; the oxide-based compound of $(Sr,Ba,Ca,Mg)_3SiO_5:Eu^{2+}$ including $M_3SiO_5$; the sulphur-based compound including $SrGa_2S_4$; Eu; the nitride-based compound including β-SiAlON; a nitride or oxynitride crystal employing Eu among crystals having a β-type $Si_3N_4$ crystal structure; $Ba_2MgSi_2O_7:Eu^{2+}$; $Ba_2ZnSi_2O_7:Eu^{2+}$; $BaAl_2O_4:Eu^{2+}$; $SrAl_2O_4:Eu^{2+}$; $BaMgAl_{10}O_{17}:(Eu^{2+},Mn^{2+})$; and $BaMg_2Al_{16}O_{27}:(Eu^{2+}, Mn^{2+})$.

In an exemplary embodiment, the red fluorescent substance FB3 may include at least one of the oxide-based compound of $Y_2O_3:(Eu^{3+},Bi^{3+})$; $(Sr,Ca,Ba,Mg,Zn)_2P_2O_7:(Eu^{2+},Mn^{2+})$; $(Ca,Sr,Ba,Mg,Zn)_{10}(PO_4)_6(F,Cl,Br,OH)_2:(Eu^{2+},Mn^{2+})$; $(Gd,Y,Lu,La)_2O_3:(Eu^{3+},Bi^{3+})$; $(Gd,Y,Lu,La)BO_3:(Eu^{3+},Bi^{3+})$; $(Gd,Y,Lu,La)(P,V)O_4:(Eu^{3}+,Bi^{3+})$; $(Ba,Sr,Ca)MgP_2O_7:(Eu^{2+},Mn^{2+})$; $(Y,Lu)_2WO_6:(Eu^{3+},Mo^{6+})$; $(Sr,Ca,Ba,Mg,Zn)_2SiO_4:(Eu^{2+},Mn^{2+})$; the sulphur-based compound of $(Ca,Sr)S:Eu^{2+}$; $(Gd,Y,Lu,La)_2O_2S:(Eu^{3+},Bi^{3+})$; $CaLa_2S_4:Ce^{3+}$; the nitride-based compound of $(Sr,Ca)AlSiN_3:Eu^{2+}$; $(Ba,Sr,Ca)_2Si_5N_8:Eu^{2+}$; and $(Ba,Sr,Ca)_2SiO_{4-x}N_y:Eu^{2+}$.

Figure 5:
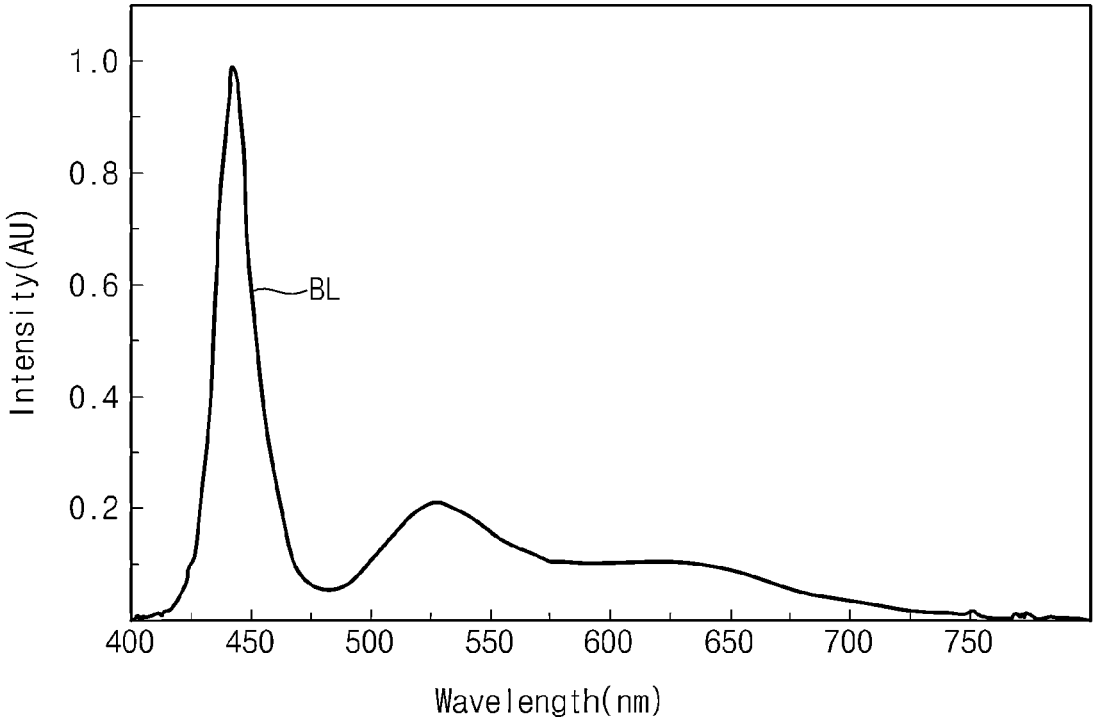
FIG. 5 is a graph of intensity (arbitrary unit) versus wavelength (nanometer) showing a spectral distribution of light emitted from a light emitting diode package employing a blue light emitting diode.

FIG. 5 is a graph of intensity (arbitrary unit) versus wavelength (nanometer) showing a spectral distribution of light emitted from a light emitting diode package employing a blue light emitting diode.

FIG. 5 shows the spectral distribution graph of the light emitted from an exemplary embodiment of the light emitting diode package including the green fluorescent substance and the red fluorescent substance on the blue light emitting diode. According to the spectral distribution graph of the blue light emitting diode package, the blue light having a wavelength of about 450 nm has a relatively large peak value and a relatively small full width at half maximum ("FWHM"). In such an embodiment, the peak value of the blue light is larger than the peak value of the green light having a wavelength of about 525 nm and the peak value of the red light having a wavelength of about 625 nm, and the FWHM of the blue light is smaller than the FWHM of the green light and the FWHM of the red light.

Figure 6:
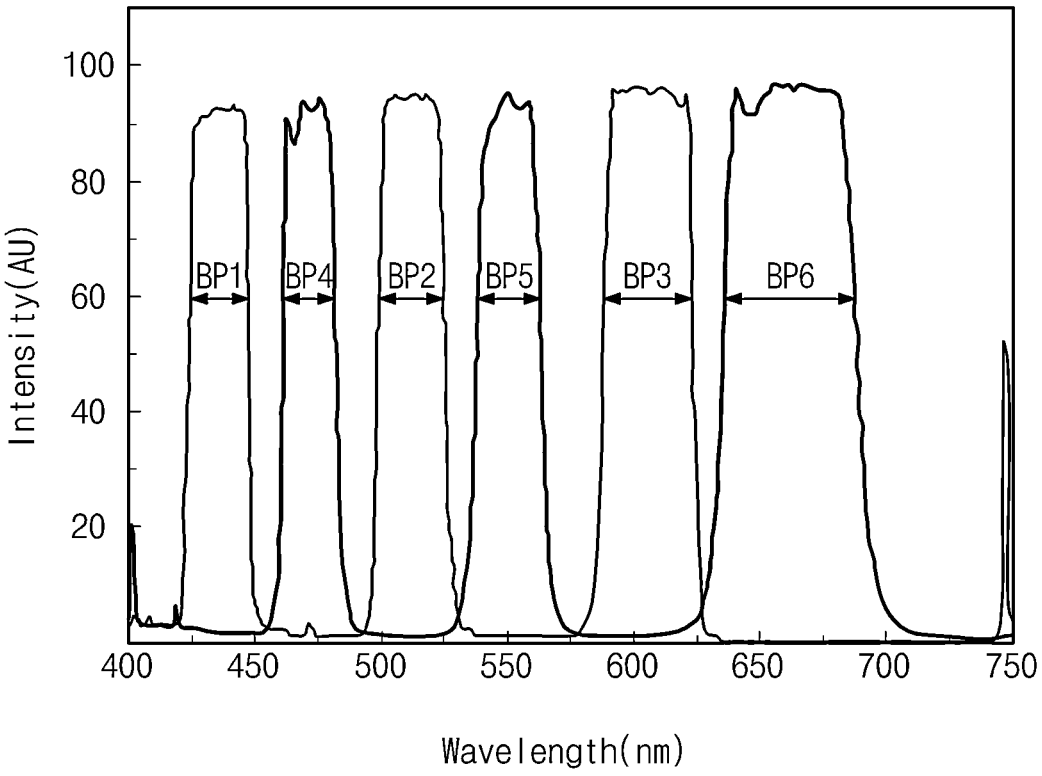
FIG. 6 is a graph of intensity (arbitrary unit) versus wavelength (nanometer) showing a spectral distribution of a band-pass filter used to separate the wavelength of the light shown in FIG. 5.

FIG. 6 is a graph of intensity (arbitrary unit) versus wavelength (nanometer) showing a spectral distribution of a band-pass filter used to separate the wavelength of the light shown in FIG. 5.

FIG. 6 shows two pass-bands used in the display apparatus to display the 3D image using the wavelength-separation of the light. The first band-pass filter of the two band-pass filters has a first pass-band BP1 in the blue range, a second pass-band BP2 in the green range and a third pass-band BP3 in the red range. The second band-pass filter of the two band-pass filters has a fourth pass-band BP4 in the blue range, a fifth pass-band BP5 in the green range and a sixth pass-band BP6 in the red range. The first band-pass filter may be used for one of the left-eye and the right-eye, and the second pass filter may be used for the other eye different from the one for which the first band-pass filter is used.

The first pass-band BP1 transmits the light having a wavelength shorter than about 450 nm that is a center wavelength of the blue light, and the fourth pass-band BP4 transmits the light having a wavelength longer than about 450 nm that is the center wavelength of the blue light. The second pass-band BP2 transmits the light having a wavelength shorter than about 525 nm that is a center wavelength of the green light, and the fifth pass-band BP5 transmits the light having a wavelength longer than about 525 nm that is the center wavelength of the green light. The third pass-band BP3 transmits the light having a wavelength shorter than about 625 nm that is a center wavelength of the red light, and the sixth pass-band BP6 transmits the light having a wavelength longer than about 625 nm that is the center wavelength of the red light.

Figure 7:
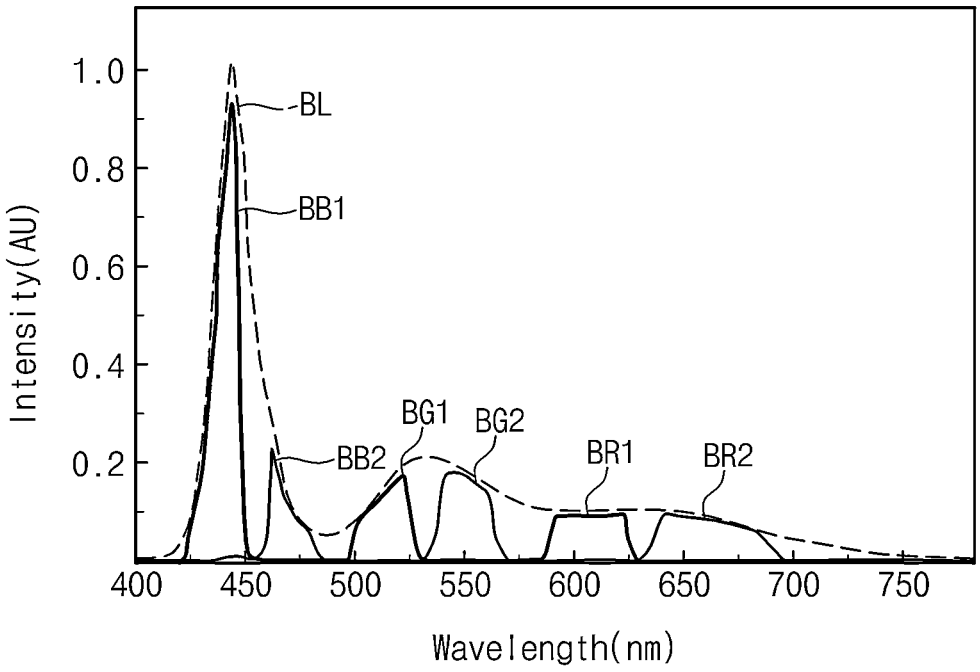
FIG. 7 is a graph of intensity (arbitrary unit) versus wavelength (nanometer) showing a spectral distribution of the light after the light of FIG. 5 passes through the pass-band shown in FIG. 6.

FIG. 7 is a graph of intensity (arbitrary unit) versus wavelength (nanometer) showing a spectral distribution of the light after the light of FIG. 5 passes through the pass-band shown in FIG. 6.

FIG. 7 shows the spectral distribution of the light after the light emitted from the exemplary embodiment of the light emitting diode package including the green fluorescent substance and the red fluorescent substance on the blue light emitting diode passes through the first and second band-pass filters. In such an embodiment, first light BB1, second light BG1 and third light BR1 transmit through the first band-pass filter, and fourth light BB2, fifth light BG2 and sixth light BR2 transmit through the second band-pass filter.

Referring to FIG. 7, the first light BB1 transmits through the first band-pass filter in the blue range has the peak value three times larger than the peak value of the fourth light BB2 that transmits through the second band-pass filter in the blue range. In an exemplary embodiment, as shown in the graph in FIG. 7, the area of the fourth light BB2 is in a range from about 25% to about 30% with respect to the area of the first light BB1. Thus, when the 3D image is displayed using the light as shown in FIG. 7, a difference between the brightness of the light provided to the left-eye of the user and the brightness of the light provided to the right-eye of the user become substantially great, such that deterioration in display quality of the display apparatus may occur.

Figure 8:
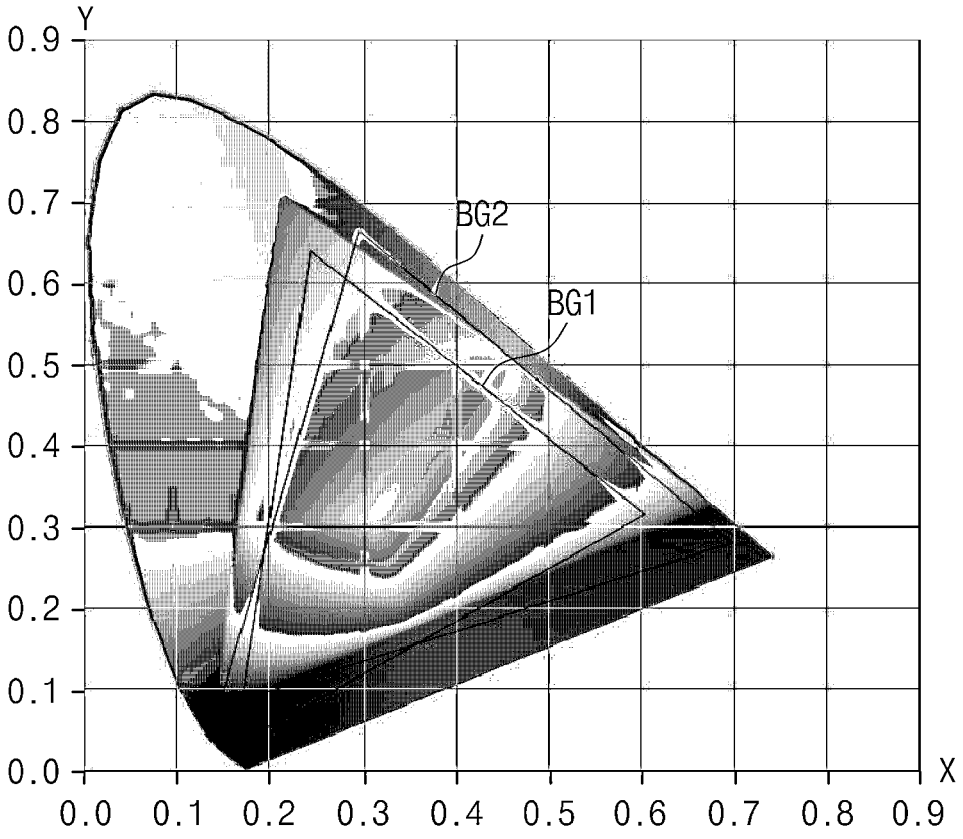
FIG. 8 is a graph showing a color reproduction range of the light shown in FIG. 7.

Table 1 (shown below) shows characteristics of the light transmitting through the first and second band-pass filters, and FIG. 8 shows a color reproduction range of the light shown in FIG. 7.

Referring to Table 1, the first, second and third lights BB1, BG1 and BR1, which passed through the first band-pass filter, have the peak values of about 445 nm, about 520 nm and about 621 nm, respectively, and have the pass-band from about 436−23/2 nm to about 436+23/2 nm, from about 512−27/2 nm to about 512+27/2 nm, and from about 606−36/2 nm to about 606+36/2 nm, respectively. The white light obtained by the first, second and third lights BB1, BG1 and BR1 has an x-axis coordinate value of about 0.249 and a y-axis coordinate value of about 0.215 on a Commission Internationale d'Eclarage ("CIE") 1931 color coordinate diagram (hereinafter, referred to as "color coordinate value"), a coincidence rate of about 91.3% against sRGB, and an area rate of about 78.2% against National Television System Committee ("NTSC").

The fourth, fifth and sixth lights BB2, BG2 and BR2, which passed through the second band-pass filter, have the peak values of about 463 nm, about 542 nm and about 641 nm, respectively, and have the pass-band from about 472−21/2 nm to about 472+21/2 nm, from about 550−24/2 nm to about 550+24/2 nm, and from about 662−53/2 nm to about 662+53/2 nm, respectively. The white light obtained by the fourth, fifth and sixth lights BB2, BG2 and BR2 has the x-axis coordinate value of about 0.249 and the y-axis coordinate value of about 0.215 on the color coordinate value, the coincidence rate of about 99.1% against sRGB, and the area rate of about 93.1% against NTSC.

TABLE 1

| | Color | Peak wavelength (nm) | Pass-band (nm) | Coordinate value of white x-axis | Coordinate value of white y-axis | Color reproducibility sRGB (%) | Color reproducibility NTSC (%) |
|---|---|---|---|---|---|---|---|
| First band-pass filter | Blue | 445 | 436 ± 23/2 | 0.249 | 0.215 | 91.3 | 78.2 |
| | Green | 520 | 512 ± 27/2 | | | | |
| | Red | 621 | 606 ± 36/2 | | | | |
| Second band-pass filter | Blue | 463 | 472 ± 21/2 | 0.249 | 0.215 | 99.1 | 93.1 |
| | Green | 542 | 550 ± 24/2 | | | | |
| | Red | 641 | 662 ± 53/2 | | | | |

Figure 9:
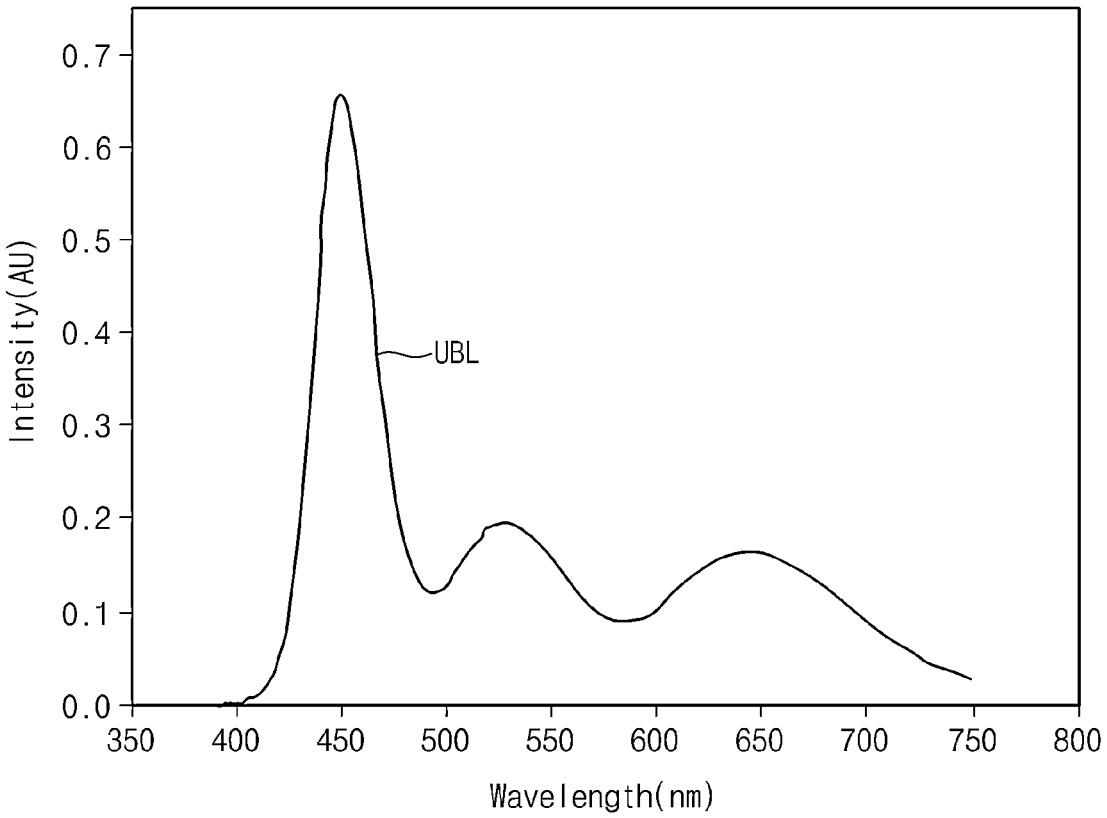
FIG. 9 is a graph of intensity (arbitrary unit) versus wavelength (nanometer) showing a spectral distribution of light emitted from the light emitting diode package shown in FIG. 4.

FIG. 9 is a graph of intensity (arbitrary unit) versus wavelength (nanometer) showing a spectral distribution of the light emitted from the light emitting diode package shown in FIG. 4.

FIG. 9 shows the spectral distribution graph of the light UBL emitted from the light emitting diode package including the blue fluorescent substance FB1, the green fluorescent substance FB2 and the red fluorescent substance FB3 disposed on the ultraviolet ray light emitting diode 620. As shown in FIG. 9, the blue light having the wavelength of about 450 nm has the peak value larger than the peak value of the green light having the wavelength of about 525 nm and the peak value of the red light having the wavelength of about 625 nm. However, the difference between the peak value of the blue light and the peak value of the green light or between the peak value of the blue light and the peak value of the red light is reduced when compared with those in FIG. 5.

The FWHM of the blue light is larger than the FWHM of the green light or the red light. However, the difference between the FWHM of the blue light and the FWHM of the green light or between the FWHM of the blue light and the FWHM of the red light is reduced when compared with those in FIG. 5.

Figure 10:
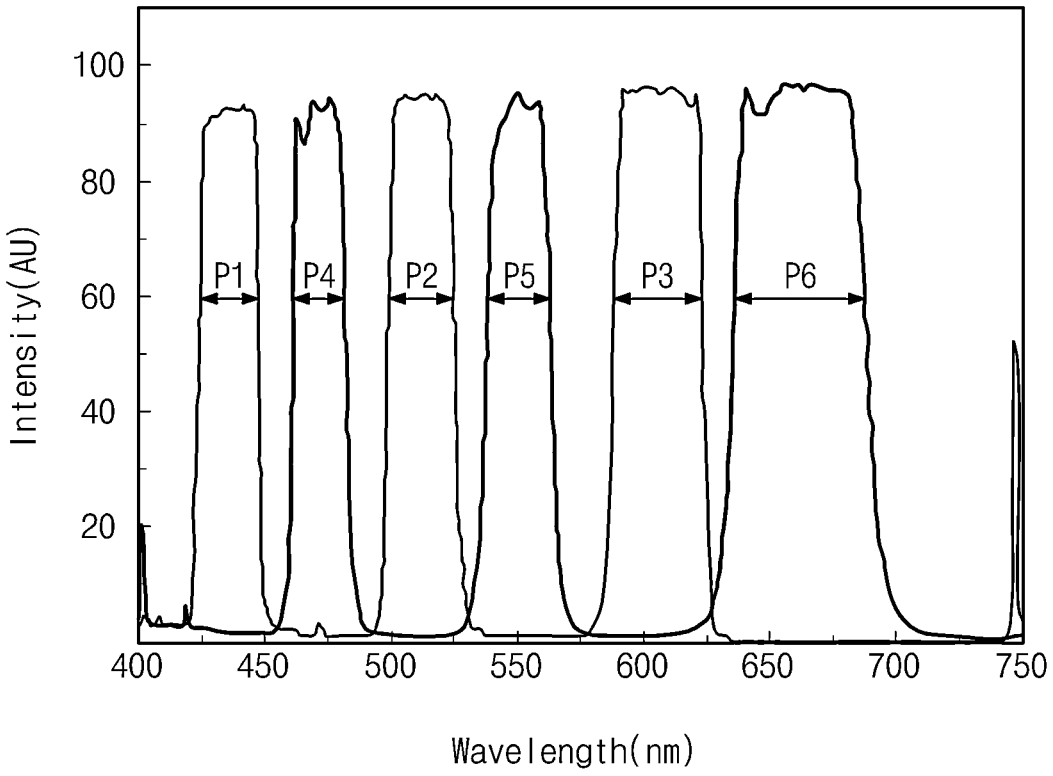
FIG. 10 is a graph of intensity (arbitrary unit) versus wavelength (nanometer) showing a spectral distribution of first and second band-pass filters shown in FIGS. 2 and 3.

FIG. 10 is a graph showing a spectral distribution of the first and second band-pass filters shown in FIGS. 2 and 3.

The first and second band-pass filters 210 and 220 are interference filters and have pass-bands different from each other. In an exemplary embodiment, the first band-pass filter 210 includes a first pass-band P1 in the blue range, a second pass-band P2 in the green range and a third pass-band P3 in the red range, and the second band-pass filter 220 includes a fourth pass-band P4 in the blue range, a fifth pass-band P5 in the green range and a sixth pass-band P6 in the red range.

The first pass-band P1 transmits the light having the wavelength shorter than about 450 nm that is the center wavelength of the blue light, and the fourth pass-band P4 transmits the light having the wavelength longer than about 450 nm that is the center wavelength of the blue light. The second pass-band P2 transmits the light having the wavelength shorter than about 525 nm that is the center wavelength of the green light, and the fifth pass-band P5 transmits the light having the wavelength longer than about 525 nm that is the center wavelength of the green light. In an exemplary embodiment, the third pass-band P3 transmits the light having the wavelength shorter than about 625 nm that is the center wavelength of the red light, and the sixth pass-band P6 transmits the light having the wavelength longer than about 625 nm that is the center wavelength of the red light.

Figure 11:
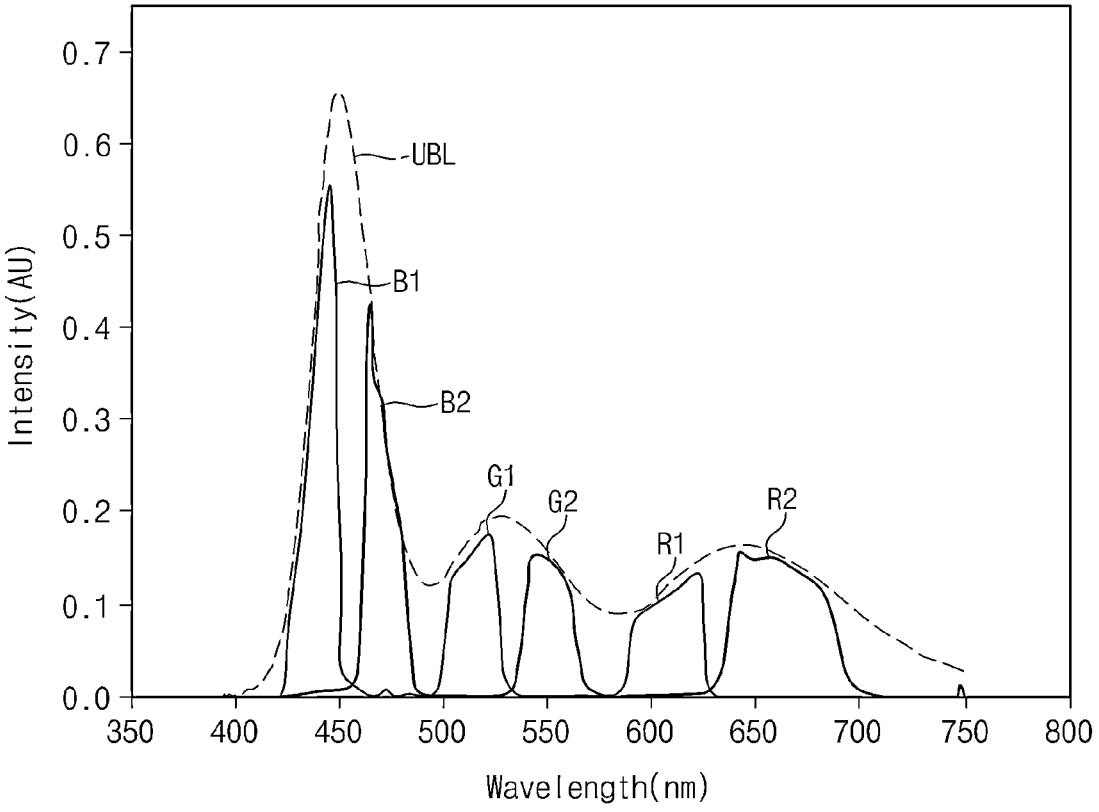
FIG. 11 is a graph of intensity (arbitrary unit) versus wavelength (nanometer) showing a spectral distribution of the light emitted from the light emitting diode package shown in FIGS. 2 and 3 after the light passes through the first and second band-pass filters.

FIG. 11 is a graph of intensity (arbitrary unit) versus wavelength (nanometer) showing a spectral distribution of the light emitted from the light emitting diode package shown in FIGS. 2 and 3 after the light transmits through the first and second band-pass filters.

Referring to FIG. 11, when the light emitted from the light emitting diodes 25 transmits through the first band-pass filter 210, first light including first blue light B1, first green light G1 and first red light R1 is generated. When the light emitted from the light emitting diodes 25 transmits through the second band-pass filter 220, second light including second blue light B2, second green light G2 and second red light R2 is generated.

The first blue light B1 has a peak wavelength different from a peak wavelength of the second blue light B2, the first green light G1 has a peak wavelength different from a peak wavelength of the second green light G2, and the first red light R1 has a peak wavelength different from a peak wavelength of the second red light R2.

In such an embodiment, the peak wavelength of the first blue light B1 is separated from the peak wavelength of the second blue light B2 at least by a FWHM of one of the first blue light B1 and the second blue light B2, the peak wavelength of the first green light G1 is separated from the peak wavelength of the second green light G2 at least by a FWHM of one of the first green light G1 and the second green light G2, and the peak wavelength of the first red light R1 is separated from the peak wavelength of the second red light R2 at least by a FWHM of one of the first red light R1 and the second red light R2.

In an exemplary embodiment, the first blue light B1 and the second blue light B2 have the wavelength in the range from about 425 nm to about 475 nm, the first green light G1 and the second green light G2 have the wavelength in the range from about 500 nm to about 550 nm, and the first red light R1 and the second red light R2 have the wavelength from about 600 nm to about 650 nm.

When comparing the first blue light B1 with the second blue light B2, the FWHM of the first blue light B1 is substantially the same as the FWHM of the second blue light B2 and a difference between the peak value of the first blue light B1 and the peak value of the second blue light B2 may be about 0.1. In an exemplary embodiment, the area of the second blue light B2 is in a range from about 80% to about 85% with respect to the area of the first blue light B1. However, the peak value difference and the area difference between the first and second blue lights B1 and B2 are substantially reduced when compared with the peak value difference and the area difference between the first light BB1 and the fourth light BB2 shown in FIG. 7.

Figure 12:
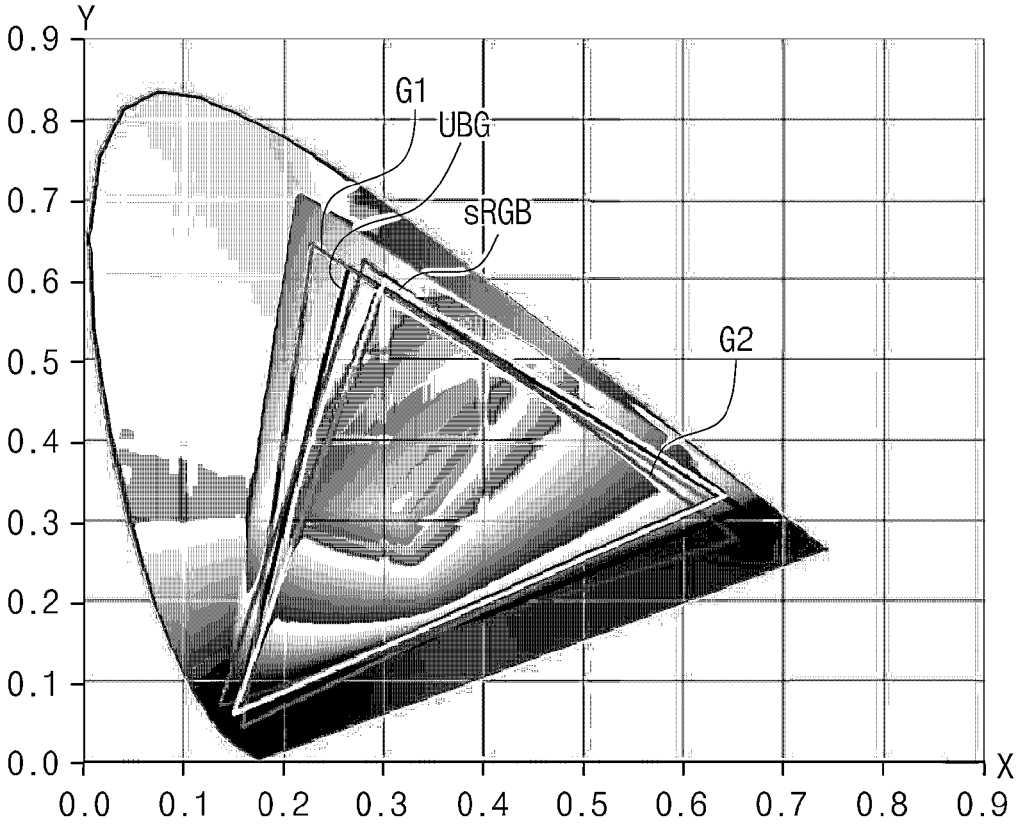
FIG. 12 is a graph showing a color reproduction range of first and second lights shown in FIG. 11.

Table 2 (shown below) shows characteristics of the first and second lights shown in FIG. 11, and FIG. 12 shows a color reproduction range of first and second lights shown in FIG. 11.

Referring to Table 2, the first blue light B1, the first green light G1 and the first red light R1, which passed through the first band-pass filter 210, have the peak values of about 445 nm, about 520 nm and about 621 nm, respectively, and have the pass-band from about 436−23/2 nm to about 436+23/2 nm, from about 512−27/2 nm to about 512+27/2 nm, and from about 606−36/2 nm to about 606+36/2 nm, respectively. In an exemplary embodiment, the white light obtained by the first blue light B1, the first green light G1 and the first red light R1 has an x-axis coordinate value of about 0.249 and a y-axis coordinate value of about 0.215 on the color coordinate value, a coincidence rate of about 94.9% against sRGB, and an area rate of about 82.5% against NTSC.

The second blue light B2, the second green light G2 and the second red light R2, which passed through the second band-pass filter 220, have the peak values of about 463 nm, about 543 nm and about 642 nm, respectively, and have the pass-bands from about 472−21/2 nm to about 472+21/2 nm, from about 550−24/2 nm to about 550+24/2 nm, and from about 662−53/2 nm to about 662+53/2 nm, respectively. In such an embodiment, the white light obtained by the second blue light B2, the second green light G2 and the second red light R2 has the x-axis coordinate value of about 0.249 and the y-axis coordinate value of about 0.215 on the color coordinate value, the coincidence rate of about 94.3% against sRGB, and the area rate of about 81.2% against NTSC.

TABLE 2

| | Color | Peak wavelength (nm) | Pass-band (nm) | Coordinate value of white x-axis | Coordinate value of white y-axis | Color reproducibility sRGB (%) | Color reproducibility NTSC (%) |
|---|---|---|---|---|---|---|---|
| First light | Blue | 445 | 436 ± 23/2 | 0.249 | 0.215 | 94.9 | 82.5 |
| | Green | 522 | 512 ± 27/2 | | | | |
| | Red | 611 | 606 ± 36/2 | | | | |
| Second light | Blue | 463 | 472 ± 21/2 | 0.249 | 0.215 | 94.3 | 81.2 |
| | Green | 543 | 550 ± 24/2 | | | | |
| | red | 642 | 662 ± 53/2 | | | | |

Referring again to Table 1 and Table 2, the coincidence rate difference of about 7.8% between the light passed through the first band-pass filter 210 and the light passed through the second band-pass filter 220 exists against the sRGB and the area rate difference of about 14.9% between the light passed through the first band-pass filter 210 and the light passed through the second band-pass filter 220 exists against the NTSC. However, as shown in Table 2, the coincidence rate difference of about 0.6% between the first light and the second light exists against the sRGB and the area rate difference of about 1.3% between the first light and the second light exists against the NTSC. Accordingly, the color difference between the light for the left-eye and the light for the right-eye and the brightness difference between the light for the left-eye and the light for the right-eye are substantially improved in an embodiment where the ultraviolet ray light emitting diode is used as the light source than an embodiment where the blue light emitting diode is used as the light source.

Figure 13:
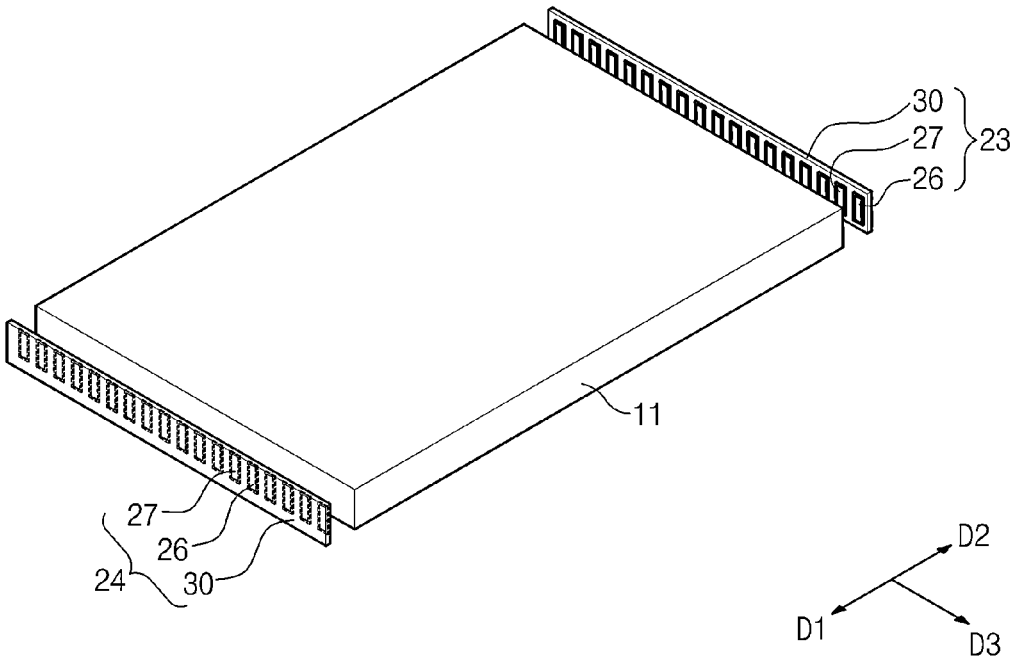
FIG. 13 is an exploded perspective view of an alternative exemplary embodiment of a backlight unit according to the invention.

FIG. 13 is an exploded perspective view of an alternative exemplary embodiment of a backlight unit according to the invention.

Referring to FIG. 13, the backlight unit 201 includes a first light source part 23, a second light source part 24 and a light guide plate 11.

The first light source part 23 includes a plurality of first light emitting diode packages 26, a plurality of second light emitting diode package 27 and a printed circuit board 30. The second light source part 24 includes a plurality of first light emitting diode packages 26, a plurality of second light emitting diode packages 27 and a printed circuit board 30.

The first light emitting diode packages 26 and the second light emitting diode packages 27 are alternately arranged on the printed circuit board 30 along a third direction D3 in each of the first and second light source parts 23 and 24. The light emitted from the first and second light emitting diode packages 26 and 27 of the first light source part 23 travels in a first direction D1 to be provided to the light guide plate 11. The light emitted from the first and second light emitting diode packages 26 and 27 of the second light source part 24 travels in a second direction D2 to be provided to the light guide plate 11.

The light guide plate 11 guides the lights emitted from the first and second light source parts 23 and 24 to the display panel 400 shown in FIG. 1.

Figure 14:
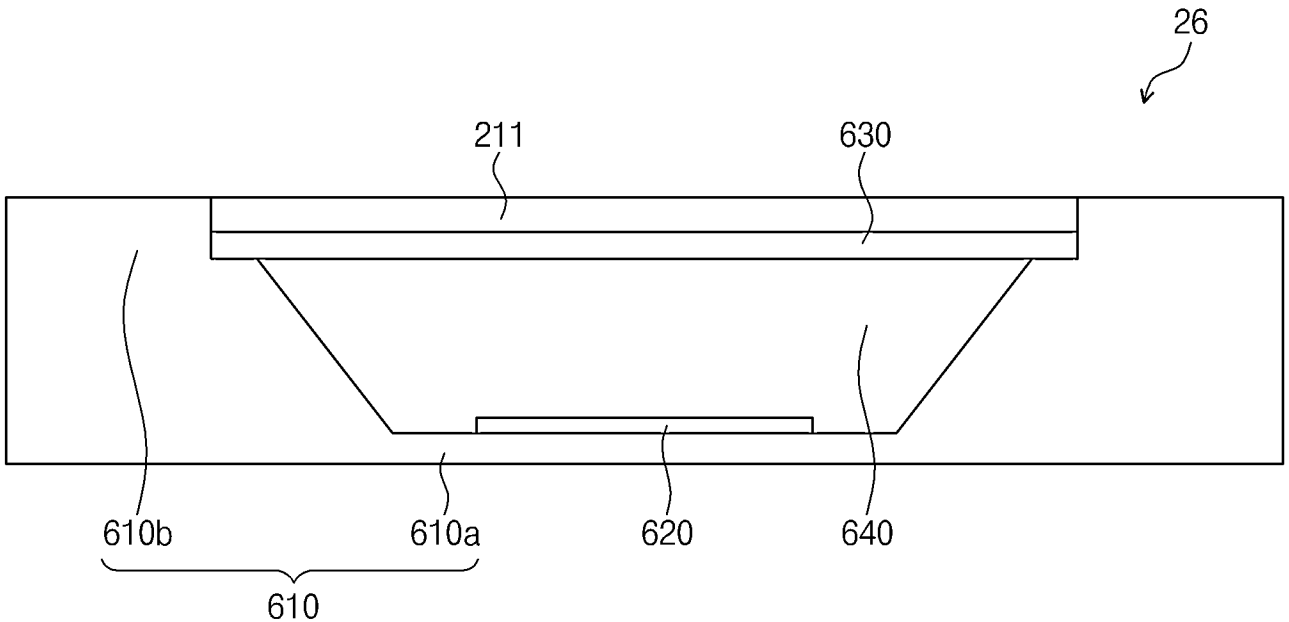
FIG. 14 is a cross-sectional view of a first light emitting diode package shown in FIG. 13 according to an exemplary embodiment of the invention.

FIG. 14 is a cross-sectional view of an exemplary embodiment of the first light emitting diode package shown in FIG. 13 according to the invention. In FIG. 14, only the first light emitting diode package 26 has been shown in detail since the first light emitting diode package 26 and the second light emitting diode package 27 have substantially the same structure and function.

Referring to FIG. 14, the first light emitting diode package 26 includes a light emitting diode 620, a first band-pass filter 211, a fluorescent substance layer 630 and a housing 610.

The light emitting diode 620 is disposed in the housing 610 to emit an ultraviolet ray. Although not shown in FIG. 14, the light emitting diode 620 is electrically connected to two lead frames that are electrically connected to the printed circuit board 30 to receive the driving voltage. Accordingly, the light emitting diode 620 generates the light in response to the voltage applied to the lead frames. In an exemplary embodiment, although not shown in FIG. 4, a heat-discharge pad or a heat-discharge plate may be disposed under the light emitting diode 620 to discharge heat generated from the light emitting diode 620.

The housing 610 includes a bottom portion 610*a* and a side portion 610*b* substantially vertically extending from the bottom portion 610*a* and provides an inner space that accommodates the light emitting diode 620 and the fluorescent substance layer 630. In such an embodiment, one side of the housing 610 is opened, and the light emitting diode 620 is disposed on the bottom portion 610*a*, and the first band-pass filter 211 and the fluorescent substance layer 630 are disposed on the side portion 610*b*. The side portion 610*b* supports the first band-pass filter 211 and the fluorescent substance layer 630.

The fluorescent substance layer 630 is disposed facing the light emitting diode 620 and an air layer 640 is interposed therebetween. The fluorescent substance layer 630 may have a thickness of about 100 nm to about 1000 micrometers (μm). In an exemplary embodiment, the fluorescent substance layer 630 may be in contact with and may be integrally formed with the first band-pass filter 211. As described above, when the fluorescent substance layer 630 is formed to have a thin film shape, the air layer 640 is provided between the light emitting diode 620 and the fluorescent substance layer 630. In such an embodiment, the heat generated from the light emitting diode 620 may be easily discharged, and the fluorescent substance layer 630 is effectively prevented from being deformed by the heat.

Although not shown in FIG. 14, the fluorescent substance layer 630 includes a polymer resin and a plurality of fluorescent substances dispersed in the polymer resin. The polymer resin may include the insulating polymer, such as silicon resin, epoxy resin and acryl resin, for example.

Although not shown in FIG. 14, the first light emitting diode package 26 and the second light emitting diode package 27 may have substantially the same structure and function except that the first light emitting diode package 26 includes a first band-pass filter 211 and the second light emitting diode package 27 includes a second band-pass filter having a pass-band different from a pass-band of the first band-pass filter 211.

Figure 15:
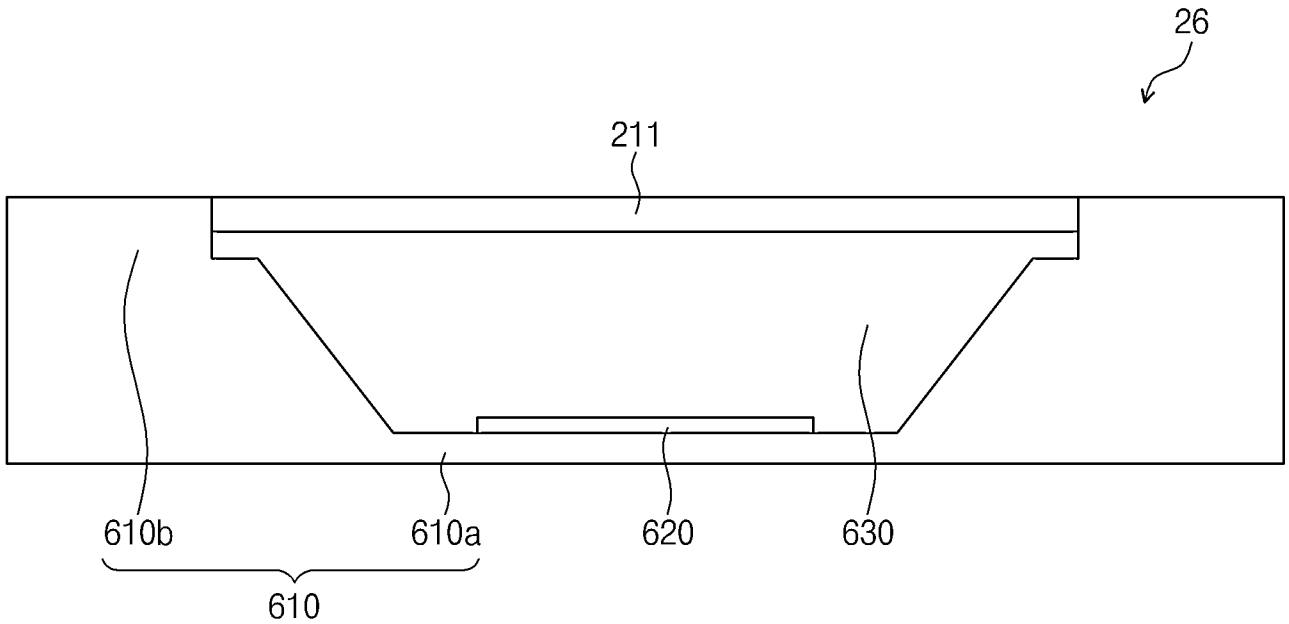
FIG. 15 is a cross-sectional view of an exemplary embodiment of a first light emitting diode package shown in FIG. 13 according to the invention.

FIG. 15 is a cross-sectional view of an alternative exemplary embodiment of a first light emitting diode package shown in FIG. 13 according to the invention. In FIG. 15, only the first light emitting diode package 26 has been shown in detail since the first light emitting diode package 26 and the second light emitting diode package 27 have substantially the same structure and function.

Referring to FIG. 15, the first light emitting diode package 26 includes a light emitting diode 620, a first band pass filter 211, a fluorescent substance layer 630 and a housing 610.

The light emitting diode 620 is disposed in the housing 610 to emit an ultraviolet ray. Differently from FIG. 14, the fluorescent substance layer 630 is disposed on the light emitting diode 620 without the air layer in FIG. 15. In such an embodiment, the fluorescent substance layer 630 fills the space between the light emitting diode and the first band-pass filter 211 being in contact with the light emitting diode 620 without being formed in the thin film shape.

Although not shown in FIG. 15, the first light emitting diode package 26 and the second light emitting diode package 27 may have substantially the same structure and function except that the first light emitting diode package 26 includes the first band-pass filter 211 and the second light emitting diode package 27 includes a second band-pass filter having a pass-band different from a pass-band of the first band-pass filter 211.

Figure 16:
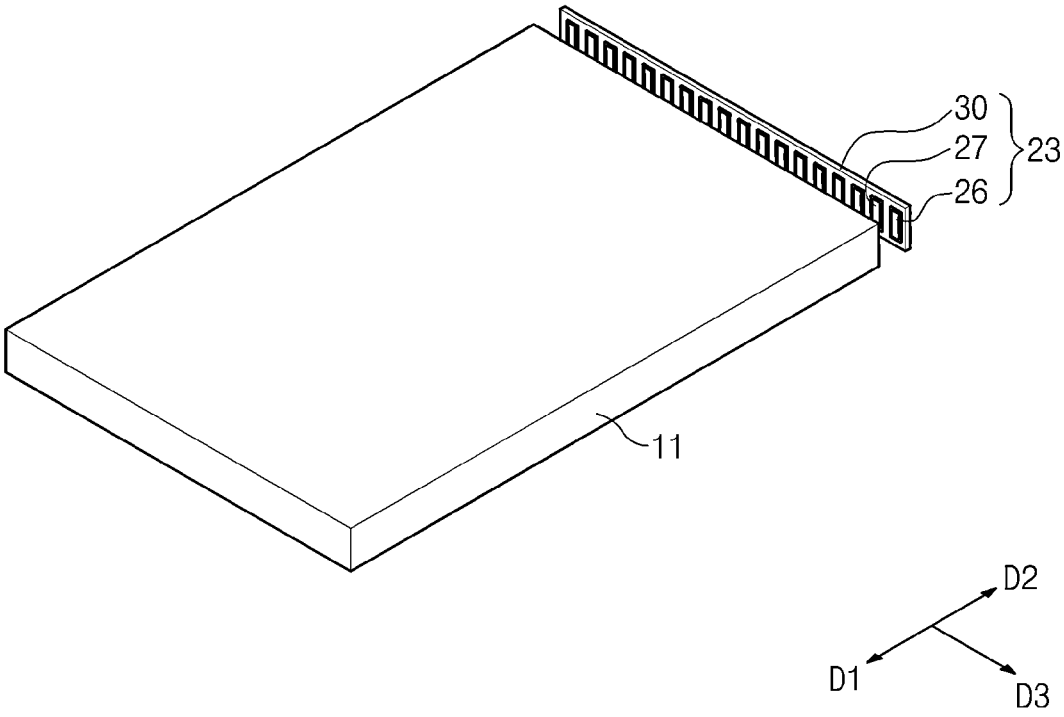
FIG. 16 is an exploded perspective view of an alternative exemplary embodiment of a backlight unit according to the invention.

FIG. 16 is an exploded perspective view of an alternative exemplary embodiment of a backlight unit according to the invention.

Referring to FIG. 16, the backlight unit 201 includes a first light source part 23 and a light guide plate 11.

The first light source part 23 includes a plurality of first light emitting diode packages 26, a plurality of second light emitting diode packages 27 and a printed circuit board 30.

In the first light source part 23, the first light emitting diode packages 26 and the second light emitting diode packages 27 are alternately arranged along a third direction D3 on the printed circuit board 30. The light emitted from the first and second light emitting diode packages 26 and 27 of the first light source part 23 travels in a first direction D1 to be provided to the light guide plate 11.

The light guide plate 11 guides the light emitted from the first light source part 23 to the display panel 400 shown in FIG. 1.

The first and second light emitting diode packages 26 and 27 may have substantially the same structure and function as those of the light emitting diode packages shown in FIGS. 14 and 15, and thus any repetitive detailed descriptions of the first and second light emitting diode packages 26 and 27 shown in FIG. 16 will be omitted.

As shown in FIG. 16, the first light source part 23 includes the first light emitting diode packages 26 and the second light emitting diode packages 27, but the first light source part 23 may include only one of the first light emitting diode package 26 and the second light emitting diode package 27 in a display apparatus that displays only two-dimensional ("2D") images.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display apparatus comprising:

a backlight unit which generates first light and second light including first and second blue light, first and second green light and first and second red light, respectively; and a display panel which receives the first and second light to display an image, wherein the backlight unit comprises:

a light emitting diode which generates an ultraviolet ray;

a fluorescent substance layer disposed on the light emitting diode, wherein the fluorescent substance layer comprises:

a blue fluorescent substance layer which receives the ultraviolet ray and emits blue light;

a green fluorescent substance layer which receives the ultraviolet ray and emits green light; and a red fluorescent substance layer which receives the ultraviolet ray and emits red light; and first and second band-pass filters which receive the blue light, the green light and the red light and output the first and second blue light, the first and second green light and the first and second red light, respectively.

2. The display apparatus of claim 1, wherein the display panel receives the first light and the second light to display a three-dimensional image.

3. The display apparatus of claim 2, wherein the first blue light has a peak wavelength different from a peak wavelength of the second blue light, the first green light has a peak wavelength different from a peak wavelength of the second green light, and the first red light has a peak wavelength different from a peak wavelength of the second red light.

4. The display apparatus of claim 3, wherein the peak wavelength of the first blue light is separated from the peak wavelength of the second blue light at least by a full width at half maximum of the first blue light or the second blue light, the peak wavelength of the first green light is separated from the peak wavelength of the second green light at least by a full width at half maximum of the first green light or the second green light, and the peak wavelength of the first red light is separated from the peak wavelength of the second red light at least by a full width at half maximum of the first red light or the second red light.

5. The display apparatus of claim 3, wherein the ultraviolet ray emitted from the light emitting diode has a wavelength from about 350 nanometers to about 400 nanometers.

6. The display apparatus of claim 5, wherein each of the first and second blue lights has a wavelength in a range from about 425 nanometers to about 475 nanometers, each of the first and second green lights has a wavelength in a range from about 500 nanometers to about 550 nanometers, and each of the first and second red lights has a wavelength in a range from about 600 nanometers to about 650 nanometers.

7. The display apparatus of claim 3, wherein the first band-pass filter comprises:

a first pass-band through which the first blue light transmits;

a second pass-band through which the first green light transmits; and a third pass-band through which the first red light transmits, and the second band-pass filter comprises:

a fourth pass-band through which the second blue light transmits;

a fifth pass-band through which the second green light transmits; and a sixth pass-band through which the second red light transmits.

8. The display apparatus of claim 7, wherein the first to sixth pass-bands are not overlapping each other.

9. The display apparatus of claim 3, wherein the backlight unit further comprises a housing which accommodates the light emitting diode and the fluorescent substance layer, the light emitting diode, the fluorescent layer and the housing collectively define a light emitting diode package, and the backlight unit comprises a plurality of light emitting diode package.

10. The display apparatus of claim 9, wherein each of the blue, green and red fluorescent substances comprises at least one of an oxide-based compound, a sulphur-based compound and a nitride-based compound.

11. The display apparatus of claim 10, wherein the blue fluorescent substance comprises at least one of $BaMg_2Al_{16}:Eu^{2+}$; $Sr_4Al_{14}O_{25}:Eu^{2+}$; $BaAl_{18}O_{13}:Eu^{2+}$; $(Sr,Mg,Ca,Ba)_5(PO_4)_3Cl:Eu^{2+}$; and $Sr_2Si_3O_8.2SrCl_2:Eu^{2+}$, the green fluorescent substance comprises at least one of $(Sr,Ba,Ca,Mg)_2SiO_4:Eu^{2+}$; the oxide-based compound of $(Sr,Ba,Ca,Mg)_3SiO_5:Eu^{2+}$ including $M_3SiO_5$; the sulphur-based compound including $SrGa_2S_4$;Eu; the nitride-based compound including β-SiAlON; a nitride or oxynitride crystal employing Eu among crystals having a β-type $Si_3N_4$ crystal structure; $Ba_2MgSi_2O_7:Eu^{2+}$; $Ba_2ZnSi_2O_7:Eu^{2+}$; $BaAl_2O_4:Eu^{2+}$; $SrAl_2O_4:Eu^{2+}$; $BaMgAl_{10}O_{17}:(Eu^{2+},Mn^{2+})$; and $BaMg_2Al_{16}O_{27}:(Eu^{2+},Mn^{2+})$, and the red fluorescent substance comprises at least one of $Y_2O_3:(Eu^{3+},Bi^{3+})$; $(Sr,Ca,Ba,Mg,Zn)_2P_2O_7:(Eu^{2+},Mn^{2+})$; $(Ca,Sr,Ba,Mg,Zn)_{10}(PO_4)_6(F,Cl,Br,OH)_2:(Eu^{2+},Mn^{2+})$; $(Gd,Y,Lu,La)_2O_3:(Eu^{3+},Bi^{3+})$; $(Gd,Y,Lu,La)BO_3:(Eu^{3+},Bi^{3+})$; $(Gd,Y,Lu,La)(P,V)O_4:(Eu^{3+},Bi^{3+})$; $(Ba,Sr,Ca)MgP_2O_7:(Eu^{2+},Mn^{2+})$; $(Y,Lu)_2WO_6:(Eu^{3+},Mo^{6+})$; $(Sr,Ca,Ba,Mg,Zn)_2SiO_4:(Eu^{2+},Mn^{2+})$; the sulphur-based compound of $(Ca,Sr)S:Eu^{2+}$;$(Gd,Y,Lu,La)_2O_2S:(Eu^{3+},Bi^{3+})$; $CaLa_2S_4:Ce^{3+}$; the nitride-based compound of $(Sr,Ca)AlSiN_3:Eu^{2+}$; $(Ba,Sr,Ca)_2Si_5N_8:Eu^{2+}$; and $(Ba,Sr,Ca)_{2SiO4-x}N_y:Eu^{2+}$.

12. The display apparatus of claim 9, wherein the first band-pass filter is disposed on a light emitting surface of a first part of the light emitting diode packages, and the second band-pass filter is disposed on a light emitting surface of a second part of the light emitting diode packages, which is different from the first part of the light emitting diode packages.

13. The display apparatus of claim 12, wherein the backlight unit further comprises a printed circuit board electrically connected to the light emitting diode packages to provide a driving voltage and disposed vertical to a light emitting surface of the light emitting diode.

14. The display apparatus of claim 13, wherein the backlight unit further comprises a first frame disposed on the printed circuit board, covering at least one side surface of the light emitting diode packages, and including a plurality of receiving holes which accommodates the first band-pass filter and the second band-pass filter.

15. The display apparatus of claim 14, wherein the backlight unit further comprises a second frame which covers the first frame, the first and second band-pass filters and the light emitting diode packages.

16. The display apparatus of claim 9, wherein the backlight unit further comprises a light guide plate disposed adjacent to the light emitting diode packages and which guides the first and second lights to the display panel from the light emitting diode packages.

17. The display apparatus of claim 3, wherein the light emitting diode comprises:

a first light emitting diode corresponding to the first band-pass filter; and a second light emitting diode corresponding to the second band-pass filter, and the fluorescent substance layer comprises:

a first fluorescent substance corresponding to the first band-pass filter; and a second fluorescent substance corresponding to the second band-pass filter.

18. The display apparatus of claim 17, wherein each of the blue, green and red fluorescent substances comprises at least one of an oxide-based compound, a sulphur-based compound and a nitride-based compound.

19. The display apparatus of claim 18, wherein the blue fluorescent substance comprises at least one of $BaMg_2Al_{16}:Eu^{2+}$; $Sr_4Al_{14}O_{25}:Eu^{2+}$; $BaAl_{18}O_{13}:Eu^{2+}$; $(Sr,Mg,Ca,Ba)_5(PO_4)_3Cl:Eu^{2+}$; and $Sr_2Si_3O_8.2SrCl_2:Eu^{2+}$, the green fluorescent substance comprises at least one of $(Sr,Ba,Ca,Mg)_2SiO_4:Eu^{2+}$; the oxide-based compound of $(Sr,Ba,Ca,Mg)_3SiO_5:Eu^{2+}$ including $M_3SiO_5$; the sulphur-based compound including $SrGa_2S_4$;Eu; the nitride-based compound including β-SiAlON; a nitride or oxynitride crystal employing Eu among crystals having a β-type $Si_3N_4$ crystal structure; $Ba_2MgSi_2O_7:Eu^{2+}$; $Ba_2ZnSi_2O_7:Eu^{2+}$; $BaAl_2O_4:Eu^{2+}$; $SrAl_2O_4:Eu^{2+}$; $BaMgAl_{10}O_{17}:(Eu^{2+},Mn^{2+})$; and $BaMg_2Al_{16}O_{27}:(Eu^{2+}, Mn^{2+})$, and the red fluorescent substance comprises at least one of $Y_2O_3:(Eu^{3+},Bi^{3+})$; $(Sr,Ca,Ba,Mg,Zn)_2P_2O_7:(Eu^{2+},Mn^{2+})$; $(Ca,Sr,Ba,Mg,Zn)_{10}(PO_4)_6(F,Cl,Br,OH)_2:(Eu^{2+},Mn^{2+})$; $(Gd,Y,Lu,La)_2O_3:(Eu^{3+},Bi^{3+})$; $(Gd,Y,Lu,La)BO_3:(Eu^{3+},Bi^{3+})$; $(Gd,Y,Lu,La)(P,V)O_4:(Eu^{3+},Bi^{3+})$; $(Ba,Sr,Ca)MgP_2O_7:(Eu^{2+},Mn^{2+})$; $(Y,Lu)_2WO_6:(Eu^{3+},Mo^{6+})$; $(Sr,Ca,Ba,Mg,Zn)_2SiO_4:(Eu^{2+},Mn^{2+})$; the sulphur-based compound of $(Ca,Sr)S:Eu^{2+}$; $(Gd,Y,Lu,La)_2O_2S:(Eu^{3+},Bi^{3+})$; $CaLa_2S_4:Ce^{3+}$; the nitride-based compound of $(Sr,Ca)AlSiN_3:Eu^{2+}$; $(Ba,Sr,Ca)_2Si_5N_8:Eu^{2+}$; and $(Ba,Sr,Ca)_2SiO_{4-x}N_y:Eu^{2+}$.

20. The display apparatus of claim 17, wherein the first light emitting diode and the second light emitting diode have substantially the same configuration.

21. The display apparatus of claim 17, wherein the backlight unit further comprises a first housing which accommodates the first light emitting diode, the first fluorescent substance layer and the first band-pass filter, and a second housing which accommodates the second light emitting diode, the second fluorescent substance layer and the second band-pass filter.

22. The display apparatus of claim 21, wherein the first fluorescent substance layer is disposed facing the first light emitting diode, and an air layer is interposed therebetween, and the second fluorescent substance layer is disposed facing the second light emitting diode, and an air layer is interposed therebetween.

23. The display apparatus of claim 22, wherein the first fluorescent substance layer is in contact with the first band-pass filter, and the second fluorescent substance layer is in contact with the second band-pass filter.

24. The display apparatus of claim 21, wherein the first fluorescent substance layer is in contact with the first light emitting diode, and the second fluorescent substance layer is in contact with the second light emitting diode.

25. The display apparatus of claim 2, further comprising a glasses comprising:

a first filter glass having a pass-band substantially identical to a pass-band of the first band-pass filter; and a second filter glass having a pass-band substantially identical to a pass-band of the second band-pass filter.

* * * * *